US006544010B1

(12) United States Patent
Choi

(10) Patent No.: US 6,544,010 B1
(45) Date of Patent: Apr. 8, 2003

(54) AXIAL FLOW FAN WITH BRUSHLESS DIRECT CURRENT MOTOR

(75) Inventor: Mu Yong Choi, Seoul (KR)

(73) Assignee: LG Electronics Co., Ltd., Seoul-si (KR)

( * ) Notice: Subject to any disclaimer, the term of this patent is extended or adjusted under 35 U.S.C. 154(b) by 0 days.

(21) Appl. No.: 09/590,693

(22) Filed: Jun. 9, 2000

(51) Int. Cl.[7] ..... F04B 35/04
(52) U.S. Cl. ..... 417/423.1; 416/223 R
(58) Field of Search ..... 415/220; 416/223 R; 417/423.1, 423.7, 423.12, 423.14

(56) References Cited

U.S. PATENT DOCUMENTS 2,583,374 A * 1/1952 Hoffman ..... 415/220
4,055,113 A * 10/1977 Monroe ..... 417/423.1
5,320,493 A * 6/1994 Shih et al. ..... 416/223 R
5,577,888 A * 11/1996 Capdevila ..... 415/220
5,879,141 A * 3/1999 Yokozawa et al. ..... 417/423.7
5,957,661 A * 9/1999 Hunt et al. ..... 416/223 R
6,129,528 A * 10/2000 Bradbury et al. ..... 416/223 R
6,132,170 A * 10/2000 Horng ..... 417/423.14
6,193,478 B1 * 2/2001 Lin et al. ..... 417/423.14

* cited by examiner

*Primary Examiner*—Michael Koczo
(74) *Attorney, Agent, or Firm*—Birch, Stewart, Kolasch & Birch, LLP

(57) ABSTRACT

An axial flow fan with a BLDC motor for electronic appliances is disclosed. The axial flow fan of this invention is optimally designed in axial height of both the blades and the fan housing, the number of blades, diameter ratio of the inner diameter to the outer diameter of the blades, camber ratio, pitch angle and sweep angle of the blades. The blades have an axial height higher than that of the fan housing, with a leading surface of the blades being placed outside the surface of the fan housing at a position higher than the surface of the fan housing by a predetermined projection height, thus increasing an air volume of the fan. In addition, the number of the blades is eight, with a diameter ratio of the inner diameter to the outer diameter of the fan being 0.40~0.45, thus reducing operational noise of the fan.

5 Claims, 12 Drawing Sheets

AXIAL FLOW FAN WITH BRUSHLESS DIRECT CURRENT MOTOR

BACKGROUND OF THE INVENTION

1. Field of the Invention

The present invention relates, in general, to an axial flow fan with a motor for electronic appliances, such as office or domestic electronic appliances, and, more particularly, to an axial flow fan with a BLDC(Brushless Direct Current) motor, the axial flow fan being optimally designed in diameter ratio, the number of blades, camber ratio, pitch angle and sweep angle, thus being reduced in operational noise in addition to being increased in air volume.

2. Description of the Prior Art

FIGS. 1*a* and 1*b* are plan and side views of a conventional axial flow fan integrated with a motor. FIG. 2 is a sectional view of the conventional axial flow fan taken along the line A—A of FIG. 1*a*. FIG. 3 is a sectional view of an electromagnetic induction-heating cooker provided with the conventional axial flow fan.

As shown in FIGS. 1*a* to 2, the typical size of a conventional axial flow fan is set to 92 mm(W)×92 mm (D)×25 mm(H). Such a conventional axial flow fan comprises a fan housing 7, with a motor 1 being firmly set within the housing 7. A hub 3 is firmly mounted to the rotating shaft 2 of the motor 1, with a plurality of blades 5 regularly fixed around the hub 3. The fan housing 7 covers the blades 5 so as to protect the blades 5 from external impact.

In such conventional axial flow fans, the motor 1 is typically selected from small-sized BLDC motors. The above axial flow fan also typically has seven blades 5. In the conventional axial flow fan, the axial height of the blades 5 has been set to be lower than that of the fan housing 7 as best seen in FIG. 2, and so the surface of the blades 5 is positioned lower than the surface of the housing 7.

The axial height of the fan housing 7 of a conventional axial flow fan is limited to 25 mm with the surface of the blades 5 being necessarily positioned lower than the surface of the fan housing 7. The blades 5 of the conventional axial flow fan undesirably have a simple shape.

In a detailed description, the maximum camber position of each blade 5 of the conventional axial flow fan is set to 0.45, with the camber positions being uniformly distributed on each blade 5 from the blade hub to the blade tip so as to allow the maximum camber position to be positioned close to the blade leading edge. The maximum camber ratio of each blade 5 is 2.0% at the blade hub and 8.0% at the blade tip while accomplishing a linear distribution on the blade 5. Each of the blades 5 is almost free from any sweep angle, while the pitch angle of each blade 5 is rapidly changed from 52° at the blade hub to 26° at the blade tip having a linear distribution.

Such axial flow fans have been preferably used in electromagnetic induction-heating cookers as shown in FIG. 3 for driving and cooling the cookers.

As shown in FIG. 3, the cooker has an axial flow fan 20 on the bottom wall of its casing. When the axial flow fan 20 is started, atmospheric air is sucked into the casing of the cooker through an inlet grille 21 by the suction force of the axial flow fan 20 and flows under the guide of an air guide 22, thus cooling both a heat dissipating fin 23 and a heating coil 24 prior to being discharged from the casing through an outlet grille 25.

Such axial flow fans 20 may be preferably used in a variety of electronic appliances in addition to the above-mentioned cookers. Particularly, the axial flow fans 20 may be preferably used for cooling the power supply units, lamps and LCD modules of conventional LCD projectors.

The axial flow fans 20, used in electronic appliances, such as LCD projectors and induction-heating cookers, are important elements since the fans 20 drive and cool the appliances. However, the conventional axial flow fans 20 are problematic in that they undesirably generate operational noise, disturbing those around the appliances. Particularly, the operational noise of a conventional axial flow fan 20 installed in an induction-heating cooker forms about 70 percent of the entire operational noise of the cooker. Such an operational noise of the fans 20 causes a serious defect of the electronic appliances using the fans.

That is, the operational performance and operational noise of the axial flow fans directly influence the operational performance and operational noise of appliances using the fans.

The axial height of the blades 5 of a conventional axial flow fan is designed to be lower than that of the fan housing 7. In addition, the blades 5 undesirably have a flat and wide shape with a low camber ratio, a low pitch angle and a low sweep angle. Therefore, the conventional axial flow fan merely generates a reduced air volume while undesirably increasing operational noise.

In a detailed description, when the axial height of the blades 5 is lower than that of the fan housing 7, the radially sucked air volume of the blades 5 is less than the axially sucked air volume of the blades 5. The conventional axial flow fan thus merely generates a reduced air volume while undesirably increasing operational noise.

When the blades 5 have a low sweep angle, they undesirably increase operational noise. When the blades 5 have a low pitch angle, the width of each blade 5 is reduced, thus failing to suck a desired air volume. When the blades 5 have a low camber ratio, it is almost impossible to desirably increase the static pressure of air passing through the fan. This forces the rpm of the fan to be increased so as to accomplish a desired air volume, and finally deteriorates the blowing efficiency of the fan.

Therefore, it is necessary to optimally design the axial heights of both the blades 5 and the fan housing 7, the sweep angle, pitch angle, and camber ratio of the blades 5 so as to accomplish a desired operational effect of electronic appliances using the axial flow fans while accomplishing a desired air volume of the fan in addition to a reduction in operational noise of the fan.

SUMMARY OF THE INVENTION

Accordingly, the present invention has been made keeping in mind the above problems occurring in the prior art, and an object of the present invention is to provide an axial flow fan with a BLDC motor for electronic appliances, which is optimally designed in axial height of both the blades and the fan housing, diameter ratio, the number of blades, camber ratio, pitch angle and sweep angle, thus being improved in blowing operational efficiency in addition to a reduction in operational noise.

In order to accomplish the above object, the primary embodiment of the present invention provides an axial flow fan, comprising a BLDC motor, a hub mounted to the rotating shaft of the motor, a plurality of blades mounted to the hub, and a fan housing covering the blades while holding the motor therein, wherein the blades have an axial height higher than that of the fan housing, with the leading surface of the blades being placed outside the surface of the fan housing at a position higher than the surface of the fan housing by a predetermined projection height, thus increasing an air volume of the fan.

In the primary embodiment, the number of the blades of the axial flow fan is eight, with a diameter ratio of the inner diameter to the outer diameter of the fan being 0.40~0.45, thus reducing operational noise of the fan. In this embodiment, the blades are designed to have a high sweep angle, a high pitch angle and a high camber ratio.

In the second embodiment, the number of the blades of the axial flow fan is seven, with a diameter ratio of the inner diameter to the outer diameter of the fan being 0.40~0.43, thus reducing operational noise of the fan. In this embodiment, the blades are designed to have a high sweep angle, a high pitch angle and a high camber ratio.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1A:
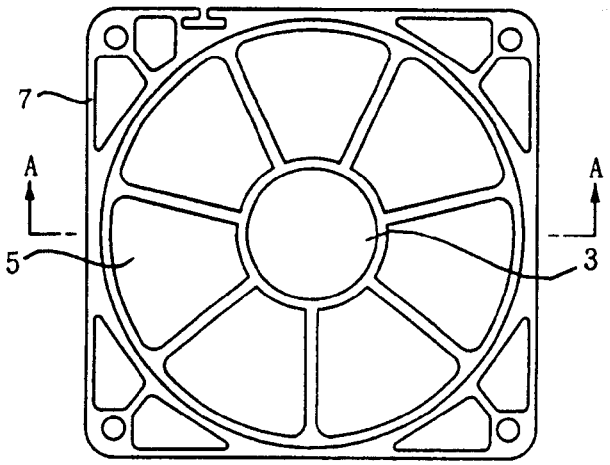
FIG.1a (Prior Art)
FIGS. 1*a* and 1*b* are plan and side views of a conventional axial flow fan integrated with a motor.
Figure 1B:
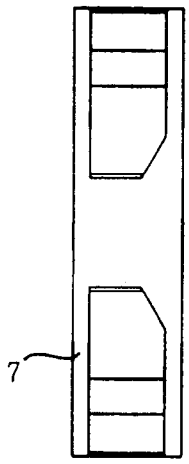
FIG.1b (Prior Art)
Figure 2:
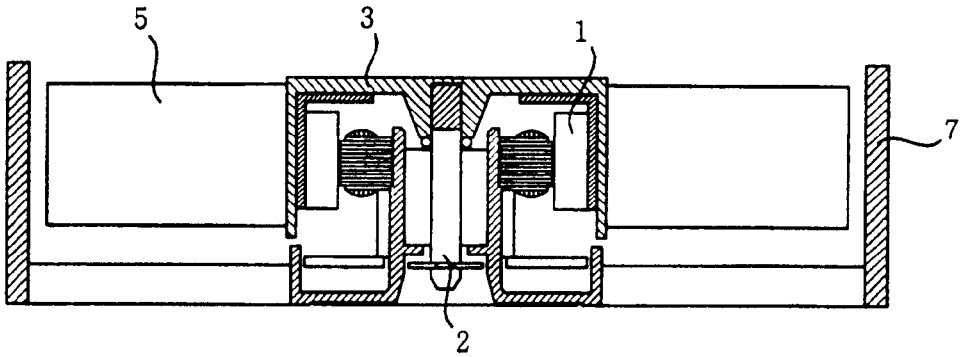
FIG.2 (Prior Art)
FIG. 2 is a sectional view of the conventional axial flow fan taken along the line A—A of FIG. 1*a;*
Figure 3:
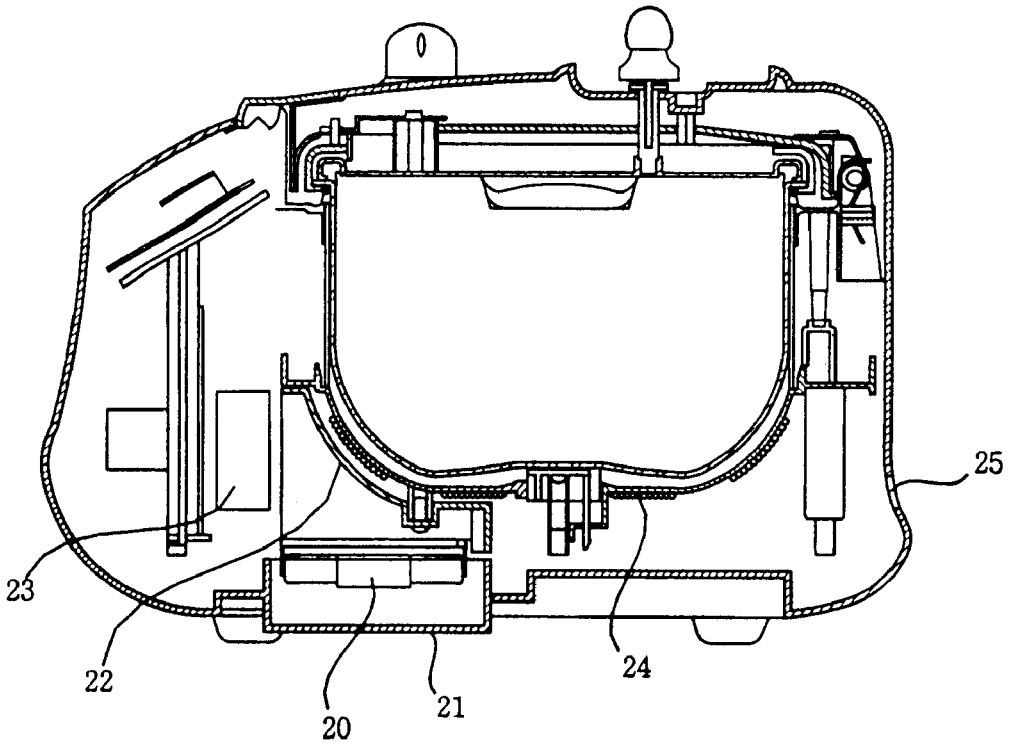
FIG.3 (Prior Art)
FIG. 3 is a sectional view of an electromagnetic induction-heating cooker provided with the conventional axial flow fan.
Figure 4A:
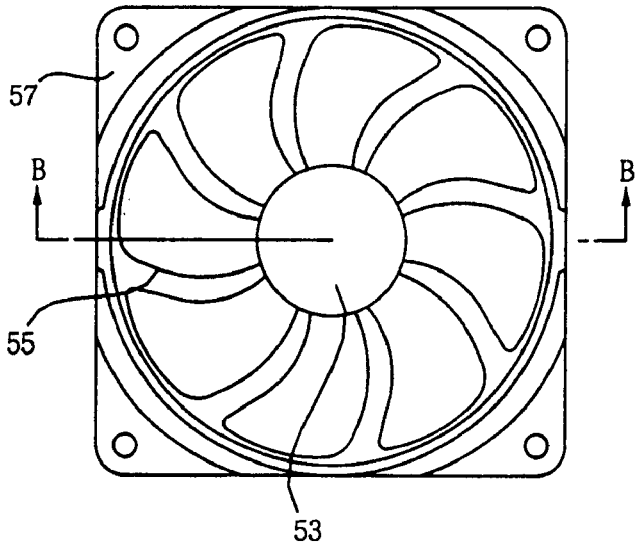
FIGS. 4*a* and 4*b* are plan and side views of an axial flow fan with a BLDC motor in accordance with the primary embodiment of the present invention.
Figure 4B:
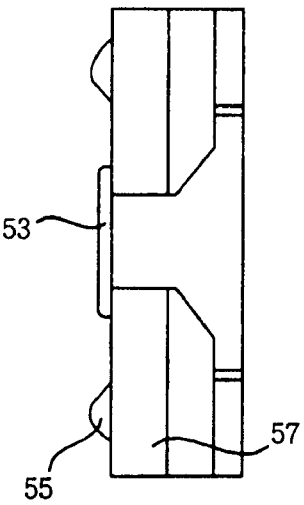
Figure 5:
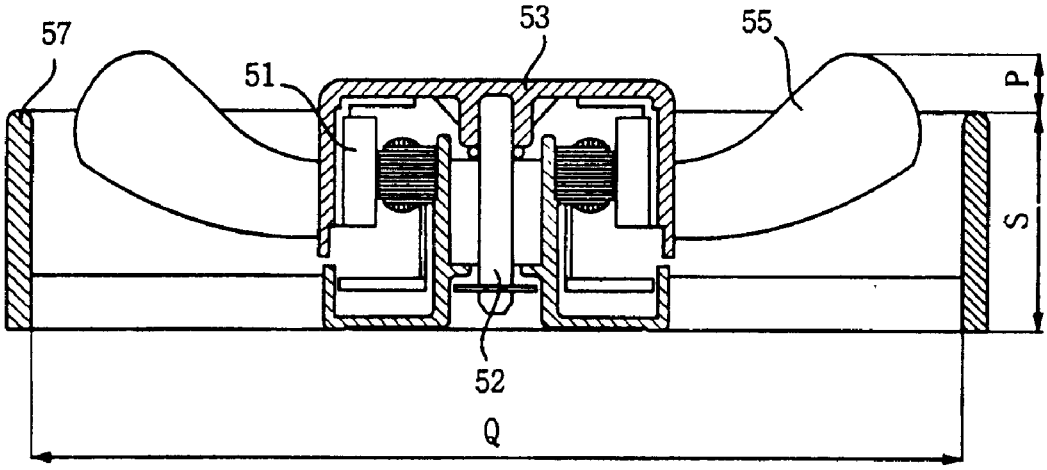
FIG. 5 is a sectional view taken along the line B—B of FIG. 4*a*, showing the construction of the axial flow fan according to the primary embodiment of this invention.
Figure 6A:
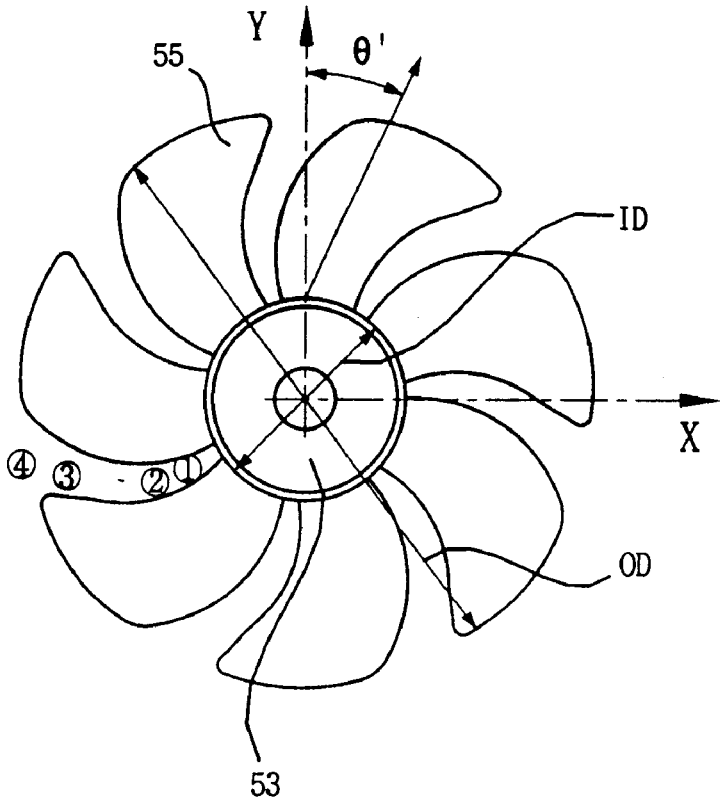
FIGS. 6*a* and 6*b* are plan and side views, showing the shape of the blades included in the axial flow fan according to the primary embodiment of this invention.
Figure 6B:
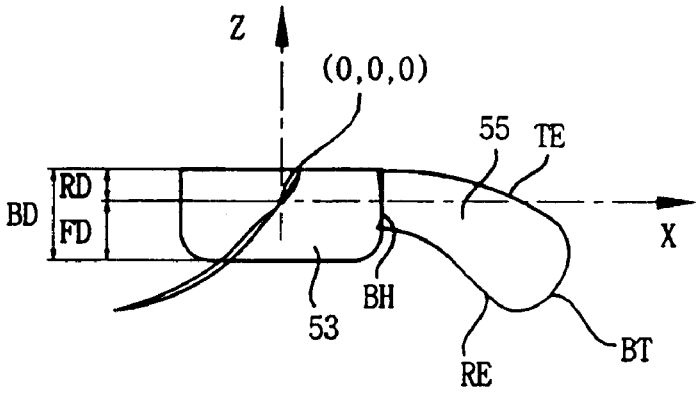
Figure 7A:
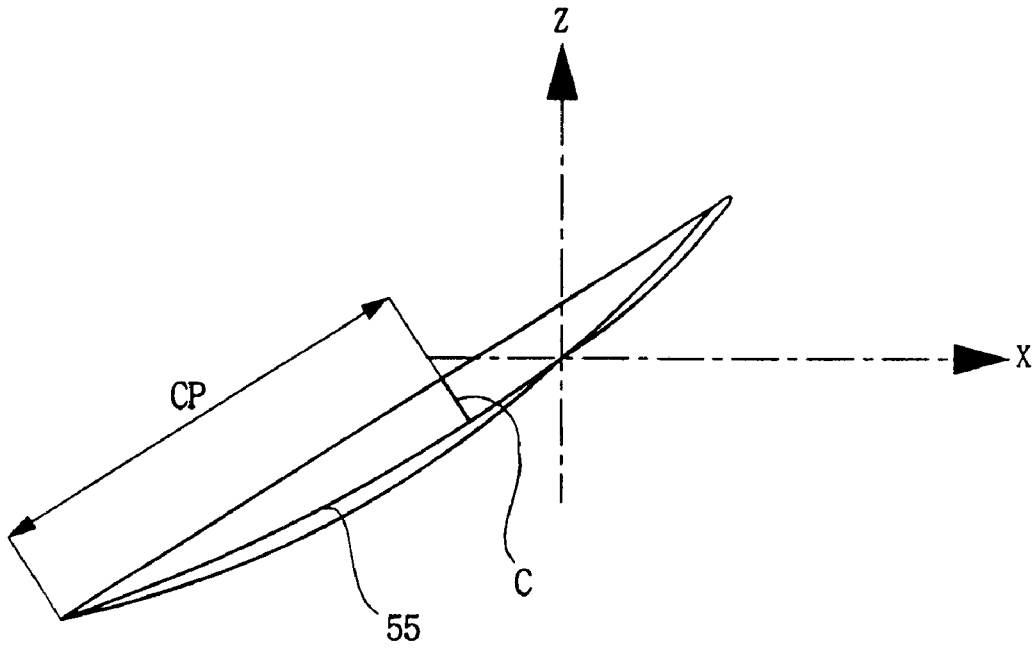
FIGS. 7*a* and 7*b* are sectional views, showing the shape of a blade included in the axial flow fan according to the primary embodiment of this invention.
Figure 7B:
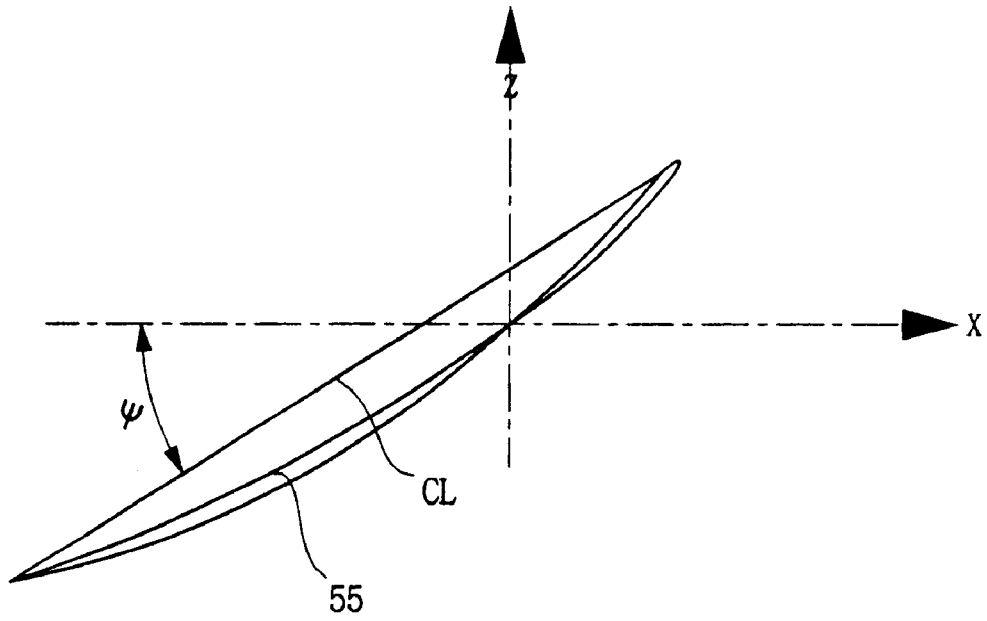

FIGS. 4*a* and 4*b* are plan and side views of an axial flow fan with a BLDC motor in accordance with the primary embodiment of the present invention. FIG. 5 is a sectional view taken along the line B—B of FIG. 4*a*, showing the construction of the axial flow fan according to the primary embodiment of this invention. FIGS. 6*a* and 6*b* are plan and side views, showing the shape of the blades included in the axial flow fan according to the primary embodiment of this invention. FIGS. 7*a* and 7*b* are sectional views, showing the shape of a blade included in the axial flow fan according to the primary embodiment of this invention.

As shown in FIGS. 4*a* to 7*b*, the axial flow fan according to the primary embodiment of this invention comprises a fan housing 57, with a motor 51 being firmly set within the housing 57. A hub 53 is firmly mounted to the rotating shaft 52 of the motor 51, with a plurality of blades 55 regularly fixed around the hub 53. The fan housing 57 covers the blades 55 so as to protect the blades 55 from external impact. The axial flow fan of this invention is optimally designed in the axial height of both the blades 55 and the fan housing 57, the number of blades 55, diameter ratio of the inner diameter ID of the fan to the outer diameter OD, camber ratio, pitch angle and sweep angle of the blades 55, thus being reduced in operational noise in addition to being increased in air volume.

In the above axial flow fan the axial height of the blades 55 relative to a lower surface of the fan housing 57 is designed to be higher than the axial height of an upper surface of the fan housing 57 relative to the lower surface of the fan housing 57 as best seen in FIG. 5. Therefore, the leading surface of the blades 55 is placed outside the upper surface of the fan housing 57 at a position higher than the upper surface of the fan housing 57 by a predetermined projection height P. Therefore, the radially sucked air volume of the blades 55 is increased by the projection height P of the blades 55, and so the axial flow fan of this invention desirably increases its air volume.

It is preferable for the axial flow fan of this invention to have eight blades 55 since the eight blades 55 are capable of desirably reducing the operational noise in addition to having an increase in air volume. In the primary embodiment, the diameter ratio of the inner diameter ID of the axial flow fan to the outer diameter OD is preferably set to 0.40~0.45, with the inner diameter ID being equal to the diameter of the hub 53.

As shown in FIGS. 5, 6*a* to 7*b*, the axial height S of the fan housing 57 is 21.0±0.4 mm, while the inner diameter Q of the fan housing 57 is 88.5±0.2 mm. On the other hand, the projection a height P of the blades 55 from the upper surface of the fan housing 57 is 4.5±0.1 mm. Therefore, the total height of the axial flow fan according to the primary embodiment is 25.5±0.5 mm, calculated by an addition of the axial height S of the fan housing 57 to the projection height P of the blades 55.

On the other hand, the outer diameter OD of the blades 55 is 86±0.5 mm, while the inner diameter ID of the blades 55 (the diameter of the hub 53) is 35±0.5 mm. Therefore, the diameter ratio of the blades 55 (the ratio of the inner diameter ID to the outer diameter OD of the blades 55) is 0.407. On the other hand, the front leading distance FD of the blades 55 is 14.0±0.4 mm, while the rear trailing distance RD of the blades 55 is 4.94±0.4 mm. In such a case, the front leading distance FD of the blades 55 forms a rotating axis extending from the center point (0, 0, 0) of a blade dater to the maximum blade leading edge RE, while the rear trailing distance RD of the blades 55 forms a rotating axis extending from the center point (0, 0, 0) of the blade dater to the maximum blade trailing edge TE. That is, the two distances ED and RD are commonly defined on the rotating axis (Z-axis) of the hub 53.

The center point (0, 0, 0) of the blade dater is positioned in the hub 53 and means the center point of the blade tips BT.

In a detailed description, the maximum camber position CP of each blade 55 is set to 0.65~0.7, with the camber positions being uniformly distributed on each blade 55 from the blade hub BH to the blade tip BT. The maximum camber ratio of each blade 55 is 3.7~4.1% at the blade hub BH and 9.7~10.1% at the blade tip BT while accomplishing a linear distribution on the blade 55.

In such a case, the maximum camber position CP of each blade 55 is located at a point at which the edge of the blade 55 is spaced furthest from a straight line extending from the blade leading edge RE to the blade trailing edge TE. The distance between said straight line and said point on each blade 55 is the maximum camber C. The maximum camber ratio is a ratio of the maximum camber C to the cord length CL. The cord length CL is the length of the straight line extending from the blade leading edge RE to the blade trailing edge TE.

The pitch angle Ψ of each blade 55 is 39.0°~40.0° at the blade hub BH and 26.0°~27.0° at the blade tip BT while being linearly distributed on the blade 55 from the blade hub BH to the blade tip BT. The pitch angle Ψ of, each blade 55 is an angle formed between the X-axis and a straight line extending between the blade leading edge RE to the blade trailing edge TE. That is, the pitch angle Ψ of each blade 55 expresses the slope of the blade 55 relative to a plane perpendicular to the Z-axis.

The sweep angle θ of each blade 55 is 0.0° at the blade hub BH and 34.0° at the blade tip BT while being quadratic-parabolically distributed on the blade 55 from the blade hub BH to the blade tip BT. The above sweep angle θ of each blade 55 is an angle formed between the Y-axis and a straight line extending between the center of the blade hub BH and the blade tip BT, with the center of the blade hub BH being positioned on the Y-axis. That is, the sweep angle θ of each blade 55 expresses the tilt of the blade 55 in the rotating direction of the blades 55.

When the axial height of the blades 55 is designed to be higher than that of the fan housing 57 so as to allow the surface of the blades 55 to be projected from the surface of the housing 57 as described above, the radially sucked air volume of the blades 55 is increased by the projection height of the blades 55. The axial flow fan of this invention thus desirably increases its air volume and reduces its operational noise.

In addition, when the axial flow fan of this invention has a high sweep angle θ, a high patch angle Ψ and a high camber ratio, the fan desirably, reduces its operational noise and has a wide blade width BD capable of increasing the air volume. In addition, it is possible to desirably increase the static pressure of air passing through the fan, and so the desired air volume of the fan may be effectively accomplished with a low rpm of the fan.

On the other hand, the blade interval between the blades 55 is set to 2.5 mm at the position ϵ, 5.0 mm at the position ∉, 7.0 mm at the position ∠, and 17.0 mm at the position ▽ as shown in FIG. 6*a*. When setting the position of the blade hub BH on each blade 55 to zero (0.00) and the position of the blade tip BT to 1.00, the blade interval is primarily set to 2.5±0.5 mm at a position around the blade hub BH. On the other hand, the blade interval within the first positional section of 0~0.75 is quadratic-parabolically, increased from 2.5±0.5 mm to 5.0±0.5 mm. In addition, the blade interval within the second positional section of 0.75~0.97 is quadratic-parabolically increased from 5.0±0.5 mm to 7.0±0.5 mm. Within the third positional section of 0.97~1.00 including the blade tip BT, the blade interval is cubic-parabolically increased from 7.0±0.5 mm to 17.0±1.0 mm.

In a brief description, the blade intervals of 5.0 mm and 7.0 mm are located at the positions of 0.75 and 0.97 of the extent from the blade hub BH to the blade tip BT. In such a case, the differentially derived function at the boundary points of 0.75 and 0.97 between the three sections is zero, while the blade interval distribution within the three sections forms quadratic and cubic-parabolic distributions.

In the axial flow fan with a BLDC motor in accordance with the primary embodiment of this invention, it is most preferable to set the axial height S of the fan housing to 21.0 mm, the inner diameter Q of the fan housing to 88.5±0.2 mm, and the projection height P of the blades from the surface of the fan housing to 4.5±0.1 mm.

It is also most preferable to set the outer diameter OD of the blades to 86 mm, the inner diameter ID of the blades to 35 mm, the front leading distance FD of the blades to 14.0±0.4 mm, the rear trailing distance RD of the blades to 4.94±0.4 mm, and the number of blades to eight.

On the other hand, it is most preferable to set the maximum camber position CP of each blade to 0.67 while uniformly distributing the camber positions on each blade 55 from the blade hub BH to the blade tip BT. In addition, the maximum camber ratio of each blade 55 is most preferably set to 3.8% at the blade hub BH and 9.89% at the blade tip BT while accomplishing a linear distribution on the blade 55.

The sweep angle θ of each blade 55 is most preferably set to 0.0° at the blade hub BH and 34.0° at the blade tip BT while accomplishing a quadratic-parabolic distribution on the blade 55 from the blade hub BH to the blade tip BT. On the other hand, the pitch angle Ψ of each blade 55 is most preferably set to 39.65° at the blade hub BH and to 26.65° at the blade tip BT while accomplishing linear distribution on the blade 55 from the blade hub BH to the blade tip BT.

The variation of operational noise of the axial flow fan according to the primary embodiment of this invention as a function of designing factors is shown in the graphs of FIGS. 8 to 11.

Figure 8:
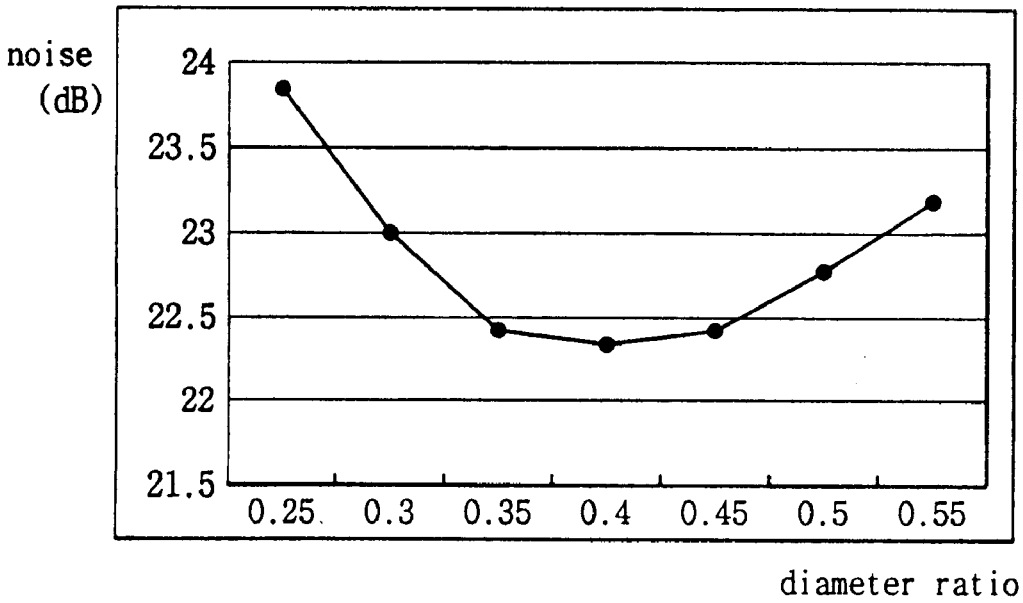
FIG. 8 is a graph showing operational noise of the axial flow fan according to the primary embodiment of this invention as a function of the diameter ratio of the axial flow fan.

FIG. 8 is a graph showing the operational noise of the axial flow fan as a function of the diameter ratio (ID/OD) of the blades 55. This graph shows that it is possible to accomplish a desired minimum operational noise of 22.4 dB±0.1 when the diameter ratio of the blades 55 is set to 0.4~0.45.

Figure 9:
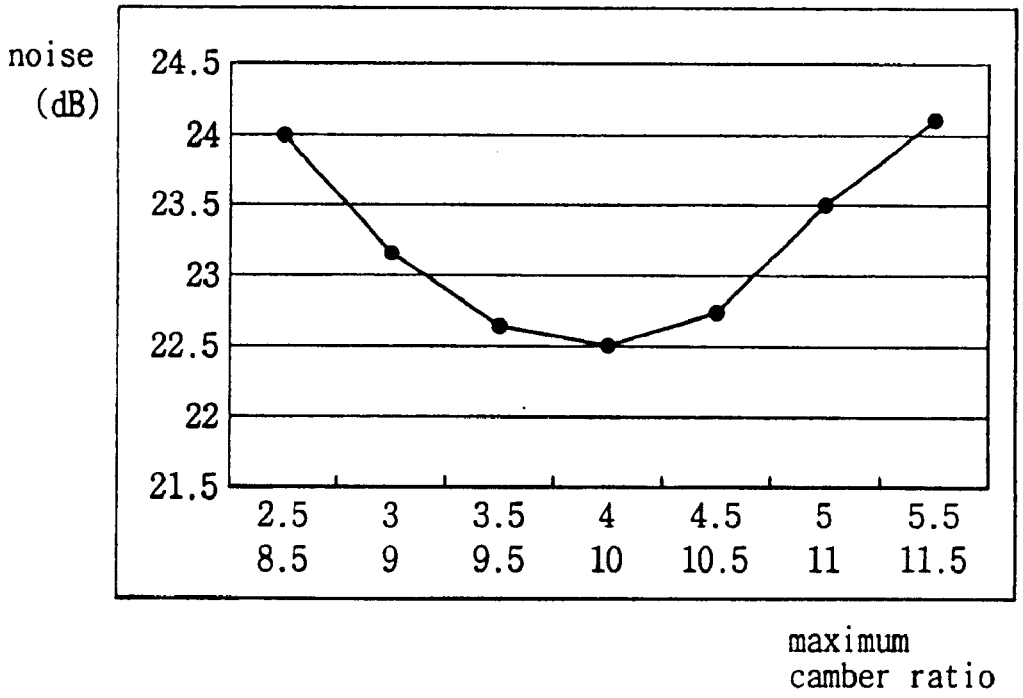
FIG. 9 is a graph showing operational noise of the axial flow fan according to the primary embodiment of this invention as a function of the maximum camber ratio of the axial flow fan.

FIG. 9 is a graph showing the operational noise of the axial flow fan as a function of the maximum camber ratio of the axial flow fan. This graph shows that it is possible to accomplish a desired low operational noise of 22.6 dB±0.1 when the maximum camber ratio of each blade 55 is set to 3.7~4.1% at the blade hub BH and to 9.7~10.1% at the blade tip BT while accomplishing a linear distribution on the blade 55. Particularly, this graph shows that when the maximum camber ratio of each blade 55 is set to 4.0% at the blade hub BH and to 10.0% at the blade tip BT while accomplishing a linear distribution on the blade 55, the desired minimum operational noise of 22.5 dB is accomplished.

Figure 10:
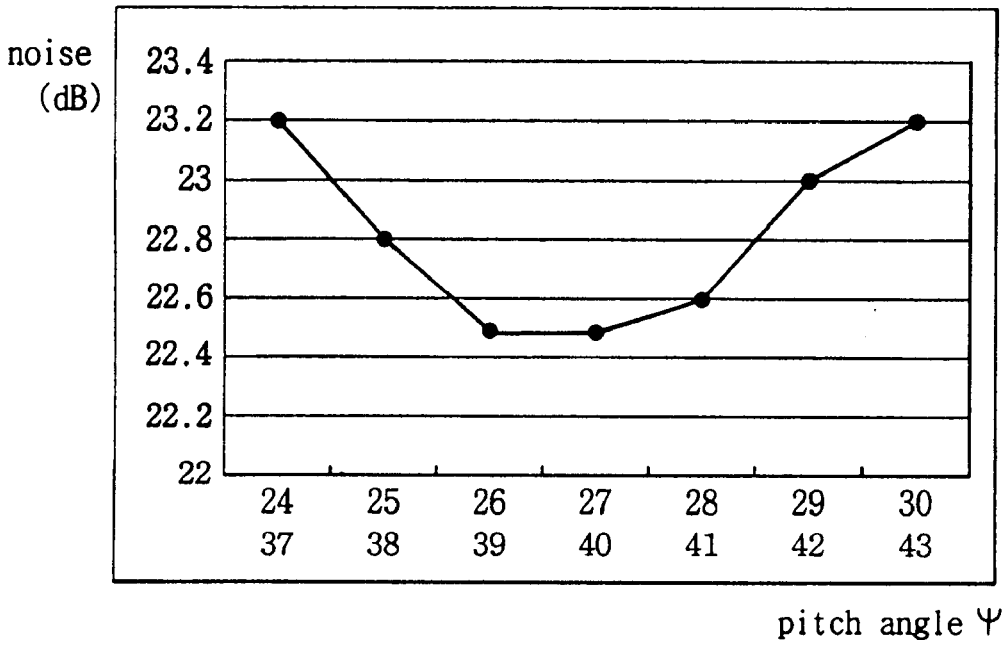
FIG. 10 is a graph showing operational noise of the axial flow fan according to the primary embodiment of this invention as a function of the pitch angle of the axial flow fan.

FIG. 10 is a graph showing the operational noise of the axial flow fan as a function of the pitch angle Ψ of the blades 55. This graph shows that it is possible to accomplish a desired minimum operational noise of 22.5 dB±0.1 when the pitch angle Ψ of each blade 55 is set to 39.0°~40.0° at the blade hub BH and to 26.0°~27.0° at the blade tip BT while accomplishing a linear distribution on the blade 55 from the blade hub BH to the blade tip BT.

Figure 11:
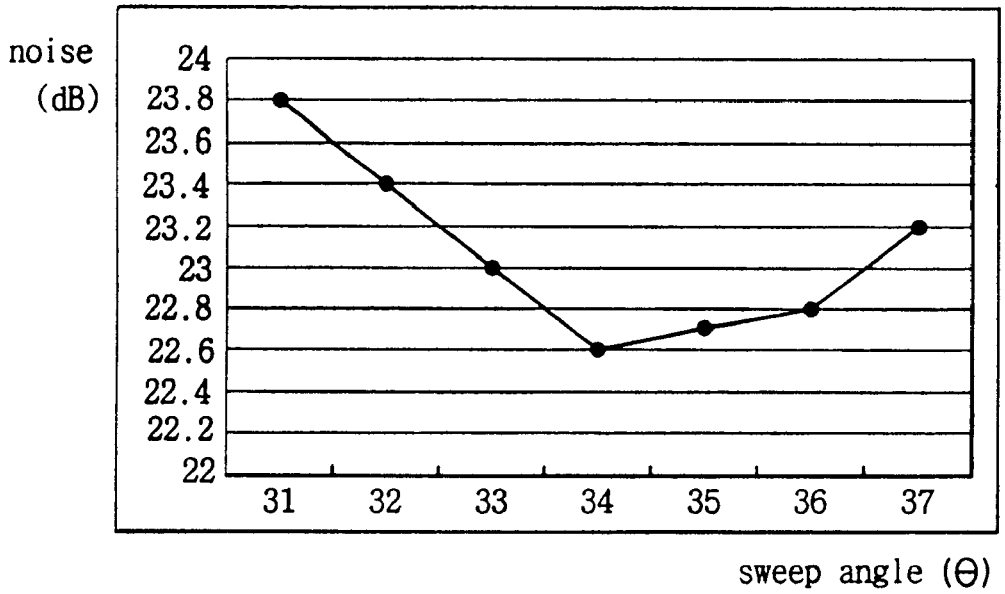
FIG. 11 is a graph showing operational noise of the axial flow fan according to the primary embodiment of this invention as a function of the sweep angle of the axial flow fan.

FIG. 11 is a graph showing operational noise of the axial flow fan as a function of sweep angle θ of the blades 55. This graph shows that it is possible to accomplish a desired minimum operational noise of 22.6 dB when the sweep angle θ of each blade 55 is set to 0.0° at the blade hub BH and to 34.0° at the blade tip BT while accomplishing a quadratic-parabolic distribution on the blade 55 from the blade hub BH to the blade tip BT.

The boundary data of the blades 55 included in the axial flow fan according to the primary embodiment of the present invention is given in Table 1. As expressed in Table 1, the axial flow fan effectively reduces its operational noise by at least 3 dB(A) in comparison with a conventional axial flow fan while providing the same air volume.

TABLE 1

| Blade Width = 18.95 mm | | |
|---|---|---|
| X | Y | Z |
| 5.526 | 16.605 | −4.580 |
| 4.352 | 16.950 | −3.810 |
| 3.172 | 17.210 | −3.003 |
| 1.993 | 17.386 | −2.164 |
| 0.821 | 17.481 | −1.298 |
| −0.339 | 17.497 | 0.409 |
| −1.481 | 17.437 | 0.498 |
| −2.599 | 17.306 | 1.422 |
| −3.652 | 17.115 | 2.404 |
| −4.628 | 16.877 | 3.457 |
| −5.526 | 16.605 | 4.580 |
| −6.003 | 19.130 | 4.863 |
| −6.292 | 21.706 | 4.941 |
| −6.384 | 24.326 | 4.808 |
| −6.261 | 26.983 | 4.461 |
| −5.903 | 29.668 | 3.907 |
| −5.280 | 32.372 | 3.159 |
| −4.219 | 35.097 | 2.146 |
| −2.622 | 37.809 | 0.884 |
| −0.463 | 40.447 | −0.544 |
| 5.960 | 42.585 | −6.394 |
| 7.397 | 42.359 | −7.669 |
| 8.967 | 42.055 | −8.651 |
| 10.602 | 41.673 | −9.468 |
| 12.257 | 41.216 | −10.200 |
| 13.902 | 40.691 | −10.902 |

TABLE 1-continued

| Blade Width = 18.95 mm | | |
|---|---|---|
| X | Y | Z |
| 15.548 | 40.091 | −11.542 |
| 17.190 | 39.415 | −12.119 |
| 18.824 | 38.661 | −12.634 |
| 20.446 | 37.828 | −13.083 |
| 22.051 | 36.915 | −13.466 |
| 23.278 | 33.080 | −13.770 |
| 20.305 | 32.002 | −13.074 |
| 17.511 | 30.708 | −12.119 |
| 14.886 | 29.228 | −10.947 |
| 12.479 | 27.556 | −9.647 |
| 10.415 | 25.667 | −8.369 |
| 8.695 | 23.599 | −7.179 |
| 7.310 | 21.385 | −6.126 |
| 6.255 | 19.049 | −5.250 |
| 5.526 | 16.605 | −4.580 |

Figure 12A:
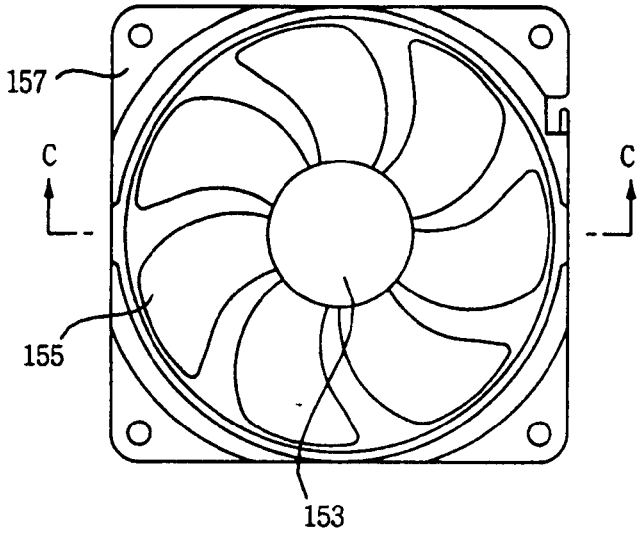
FIGS. 12*a* and 12*b* are plan and side views of an axial flow fan with a BLDC motor in accordance with the second embodiment of the present invention.
Figure 12B:
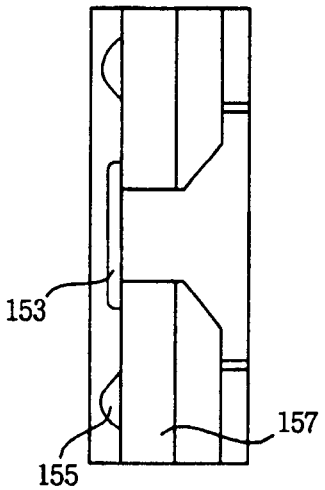
Figure 13:
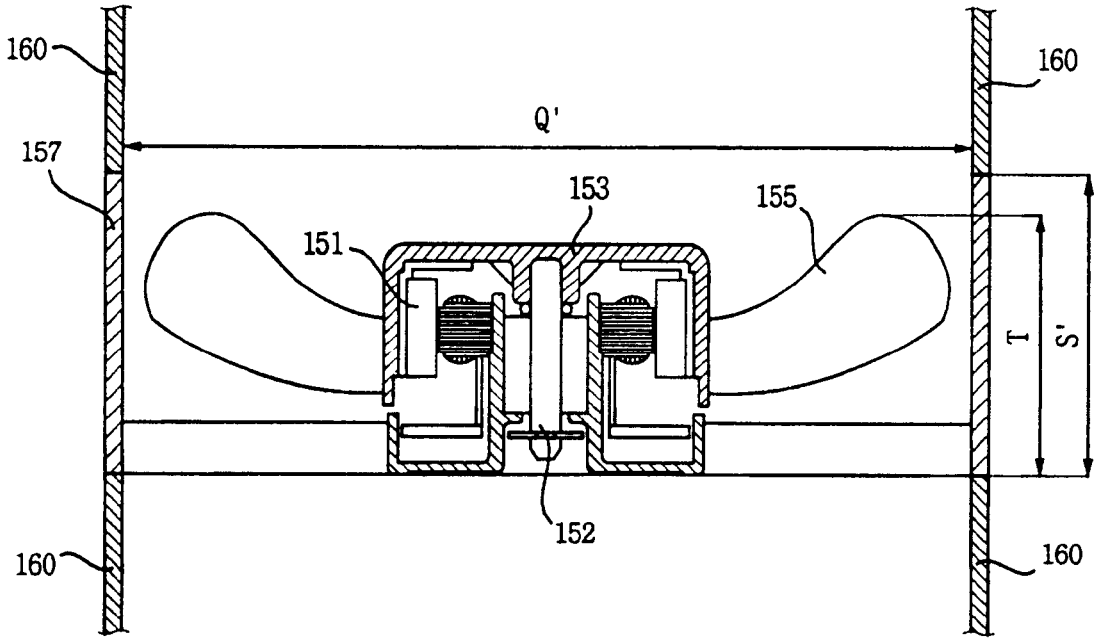
FIG. 13 is a sectional view taken along the line C—C of FIG. 12*a*, showing the construction of the axial flow fan according to the second embodiment of this invention.
Figure 14A:
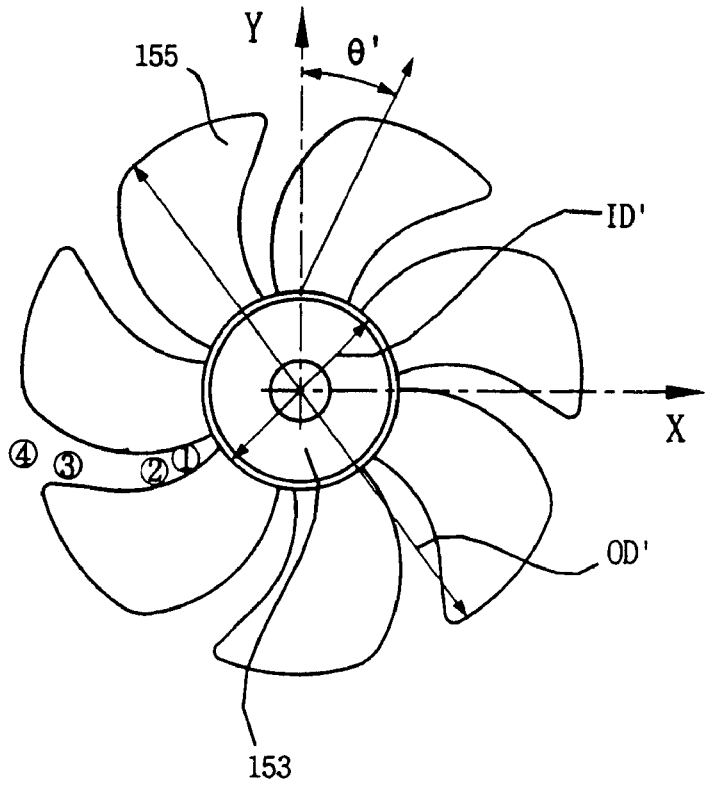
FIGS. 14*a* and 14*b* are plan and side views, showing the shape of the blades included in the axial flow fan according to the second embodiment of this invention.
Figure 14B:
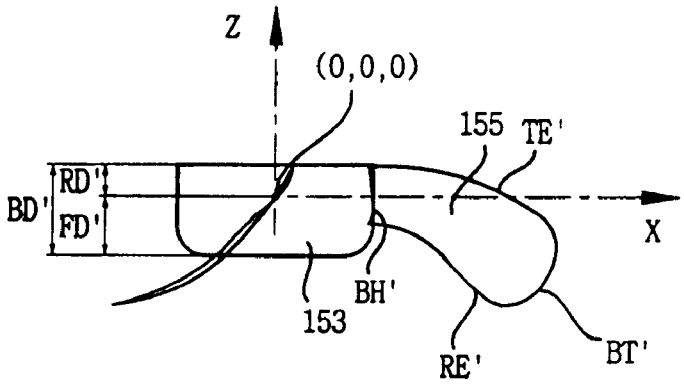
Figure 15A:
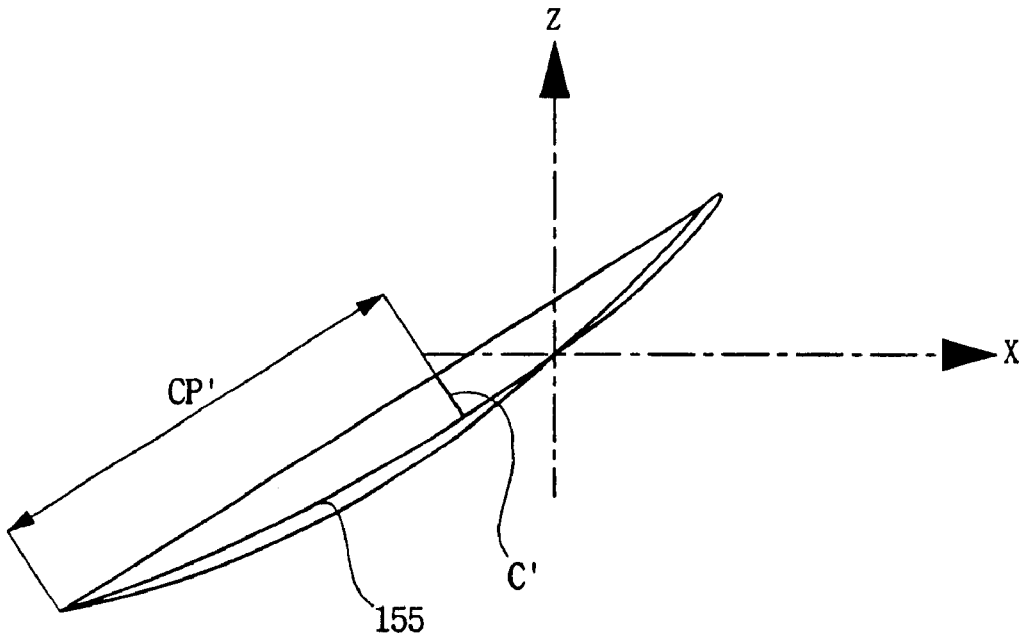
FIGS. 15*a* and 15*b* are sectional views, showing the shape of a blade included in the axial flow fan according to the second embodiment of this invention.
Figure 15B:
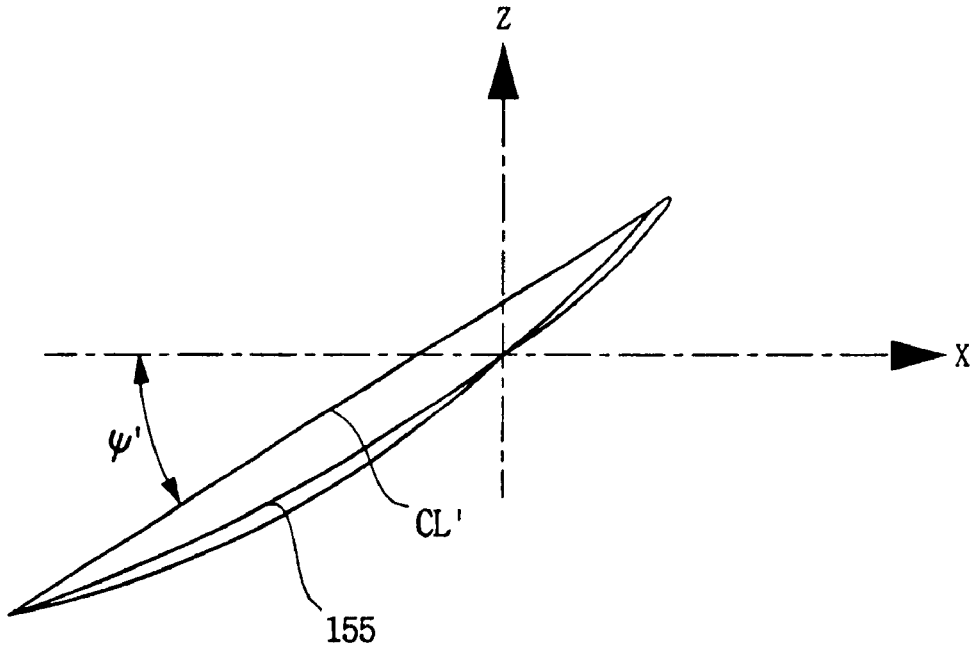

FIGS. 12*a* and 12*b* are plan and side views of an axial flow fan with a BLDC motor in accordance with the second embodiment of the present invention. FIG. 13 is a sectional view taken along the line C—C of FIG. 12*a*, showing the construction of the axial flow fan according to the second embodiment of this invention. FIGS. 14*a* and 14*b* are plan and side views, showing the shape of the blades included in the axial flow fan according to the second embodiment of this invention. FIGS. 15*a* and 15*b* are sectional views, showing the shape of a blade included in the axial flow fan according to the second embodiment of this invention.

As shown in FIGS. 14*a* to 15, the axial flow fan according to the second embodiment of this invention comprises a fan housing 157, with a motor 151 being firmly set within the housing 157. A hub 153 is firmly mounted to the rotating shaft 152 of the motor 151, with a plurality of blades 155 regularly fixed around the hub 153. The fan housing 157 is connected to a duct 160 and covers the blades 155 so as to protect the blades 155 from external impact. The axial flow fan of this embodiment is optimally designed in the number of blades 155, diameter ratio of the inner diameter of the fan to the outer diameter, camber ratio, pitch angle Ψ and sweep angle θ of the blades 155, thus being reduced in operational noise in addition to being increased in air volume.

It is preferable for the axial flow fan of this embodiment to have seven blades 155, with the diameter ratio of the inner diameter ID' of the blades 155 to the outer diameter OD' being preferably set to 0.40~0.43.

As shown in FIGS. 14*a* to 15*b*, the axial height S' of the fan housing 157 is set to 25.0±0.5 mm, while the inner diameter Q' of the fan housing 157 is set to 88.5±0.2 mm.

On the other hand, the outer diameter OD' of the blades 155 is set to 86.5±0.5 mm, while the inner diameter ID' of the blades 155 is set to 35±0.5 mm. In addition, the front leading distance FD' of the blades 155 is set to 11.51±0.4 mm, while the rear trailing distance RD' of the blades 155 is set to 6.53±0.4 mm. In such a case, the blade width BD', defined by both the front leading distance FD' and the rear trailing distance RD' of the blades 155, is 18.04±0.5 mm. On the other hand, the height T of the blades 155 is set to 23.5±0.5 mm.

The maximum camber position CP' of each blade 155 is set to 0.66~0.69, with the camber positions being uniformly distributed on each blade 155 from the blade hub BH' to the blade tip BT'. The maximum camber ratio of each blade 155 is set to 5.3~5.7% at the blade hub BH' and to 11.3~11.7% at the blade tip BT' while accomplishing a linear distribution on the blade 55 from the blade hub BH' to the blade tip BT'.

The pitch angle Ψ' of each blade 155 is set to 37.0°~39.0° at the blade hub BH' and to 24.0°~26.0° at the blade tip BT' while being linearly distributed on the blade 155 from the blade hub BH' to the blade tip BT'.

On the other hand, the sweep angle θ of each blade 155 is set to 0.0° at the blade hub BH' and to 37.0° at the blade tip BT' while accomplishing a quadratic-parabolic distribution on the blade 155 from the blade hub BH' to the blade tip BT'.

When the axial flow fan of this embodiment is designed to have such a high sweep angle θ', a high pitch angle Ψ' and a high camber ratio, the fan desirably reduces its operational noise and has a wide blade width BD' capable of increasing the air volume. In addition, it is possible to desirably increase the static pressure of air passing through the fan, and so the desired air volume of the fan may be effectively accomplished with a low rpm of the fan.

On the other hand, the blade interval between the blades 155 is set to 2.5 mm at the position ϵ, 5.0 mm at the position ∉, 5.5 mm at the position ∠, and 17.0 mm at the position ▽ as shown in FIG. 14*a*. When setting the position of the blade hub BH' on each blade 155 to zero (0.00) and the position of the blade tip BT' to 1.00, the blade interval is set to 2.5±0.5 mm at a position around the blade hub BH'. On the other hand, the blade interval within the first positional section of 0~0.8 is quadratic-parabolically increased from 2.5±0.5 mm to 5.0±0.5 mm. In addition, the blade interval within the second positional section of 0.8~0.97 is quadratic-parabolically increased from 5.0±0.5 mm to 5.5±0.5 mm. Within the third positional section of 0.97~1.00 including the blade tip BT', the blade interval is cubic-parabolically increased from 5.5±0.5 mm to 17.0±1.0 mm.

In a brief description, the blade intervals of 5.0 mm and 5.5 mm are located at the positions of 0.8 and 0.97 of the extent from the blade hub BH' to the blade tip BT'. In such a case, the differentially derived function at the boundary points of 0.8 and 0.97 between the three sections is zero, while the blade interval distribution within the three sections forms quadratic and cubic-parabolic distributions.

In the axial flow far, with a BLDC motor in accordance with the second embodiment of this invention, it is most preferable to set the size of the fan to 92 mm(W)×92 mm(D)×25 mm(H), the axial height S' of the fan housing to 25.0 mm, and the inner diameter Q' of the fan housing to 88.5 mm.

It is also most preferable to set the outer diameter OD' of the blades to 86.5 mm, the inner diameter ID' of the blades to 35 mm, and the diameter ratio (ID'/OD') to 0.405.

It is also most preferable to set the height of the blades to 23.5 mm, the front leading distance FD' of the blades to 11.51 mm, the rear trailing distance RD' of the blades to 6.53 mm, the blade width BD' to 18.04 mm, and the number of blades to seven.

On the other hand, it is most preferable to set the maximum camber position CP' of each blade to 0.67 while uniformly distributing the camber positions on each blade 155 from the blade hub BH' to the blade tip BT'. In addition, the maximum camber ratio of each blade 155 is most preferably set to 5.47% at the blade hub BH' and 11.47% at the blade tip BT' while accomplishing a linear distribution on the blade 55 from the blade hub BH' to the blade tip BT'.

The sweep angle θ' of each blade 155 is most preferably set to 0.0° at the blade hub BH' and to 37.0°~38.0° at the blade tip BT' while accomplishing a quadratic-parabolic distribution on the blade 155 from the blade hub BH' to the blade tip BT'. On the other hand, the pitch angle Ψ' of each blade 155 is most preferably set to 37.74° at the blade hub BH' and to 24.74° at the blade tip BT' while accomplishing linear distribution on the blade 155 from the blade hub BH' to the blade tip BT'.

The variation of operational noise of the axial flow fan according to the second embodiment of this invention as a function of designing factors is shown in the graphs of FIGS. 16 to 19.

Figure 16:
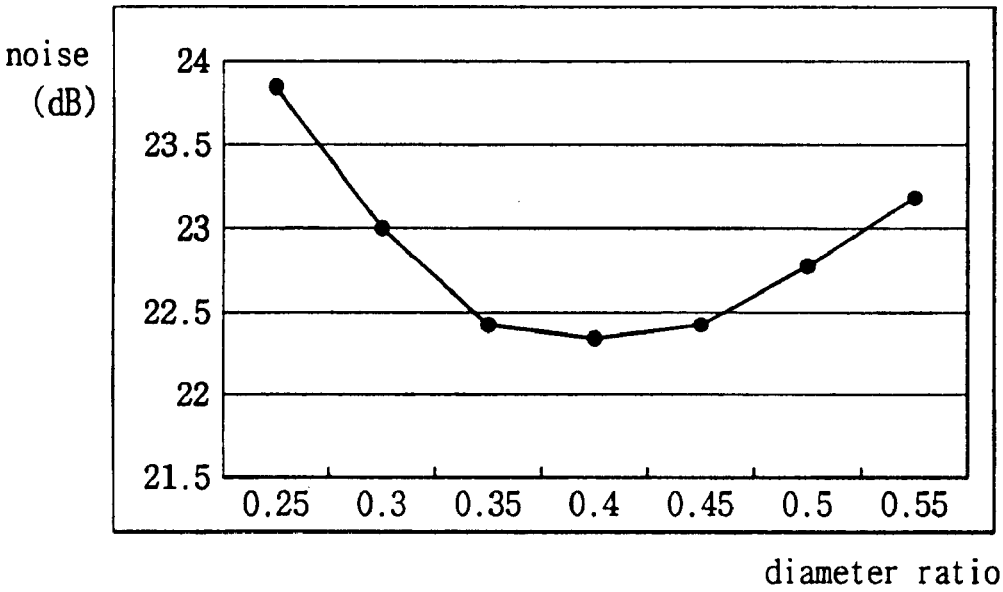
FIG. 16 is a graph showing operational noise of the axial flow fan according to the second embodiment of this invention as a function of the diameter ratio of the axial flow fan.

FIG. 16 is a graph showing the operational noise of the axial flow fan as a function of the diameter ratio (ID'/OD') of the blades 155. This graph shows that it is possible to accomplish a desired minimum operational noise of 22.4 dB±0.1 when the diameter ratio of the blades 155 is set to 0.4~0.45.

Figure 17:
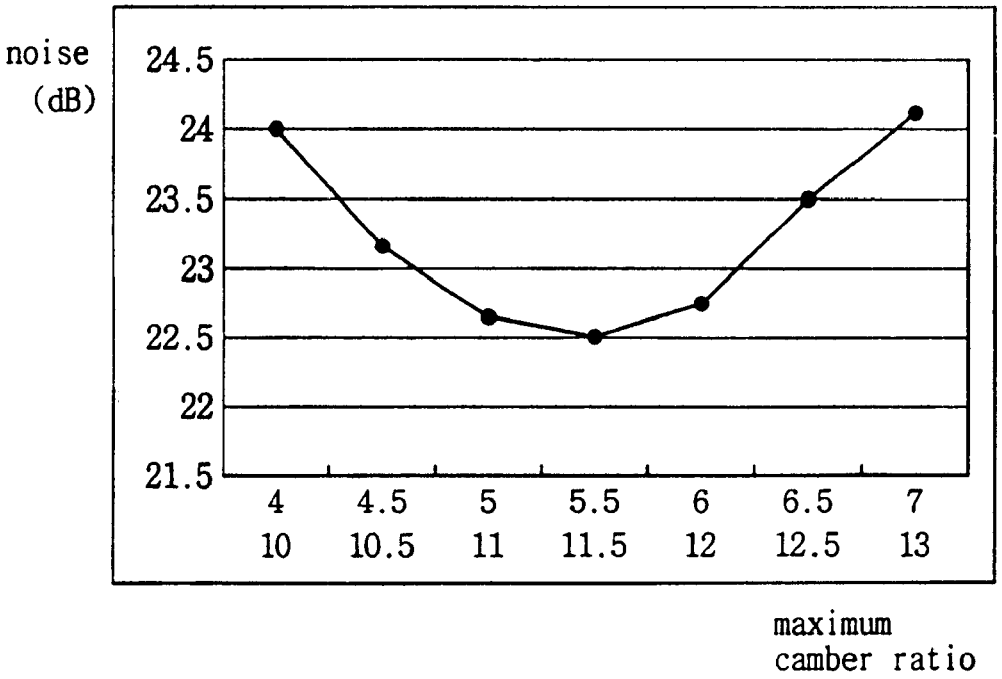
FIG. 17 is a graph showing operational noise of the axial flow fan according to the second embodiment of this invention as a function of the maximum camber ratio of the axial flow fan.

FIG. 17 is a graph showing the operational noise of the axial flow fan as a function of the maximum camber ratio of the axial flow fan. This graph shows that it is possible to accomplish a desired low operational noise of 22.4 dB when the maximum camber ratio of each blade 155 is set to 5.3~5.7% at the blade hub BH' and to 11.3~11.7% at the blade tip BT' while accomplishing a linear distribution on the blade 155 from the blade hub BH' to the blade tip BT'.

Figure 18:
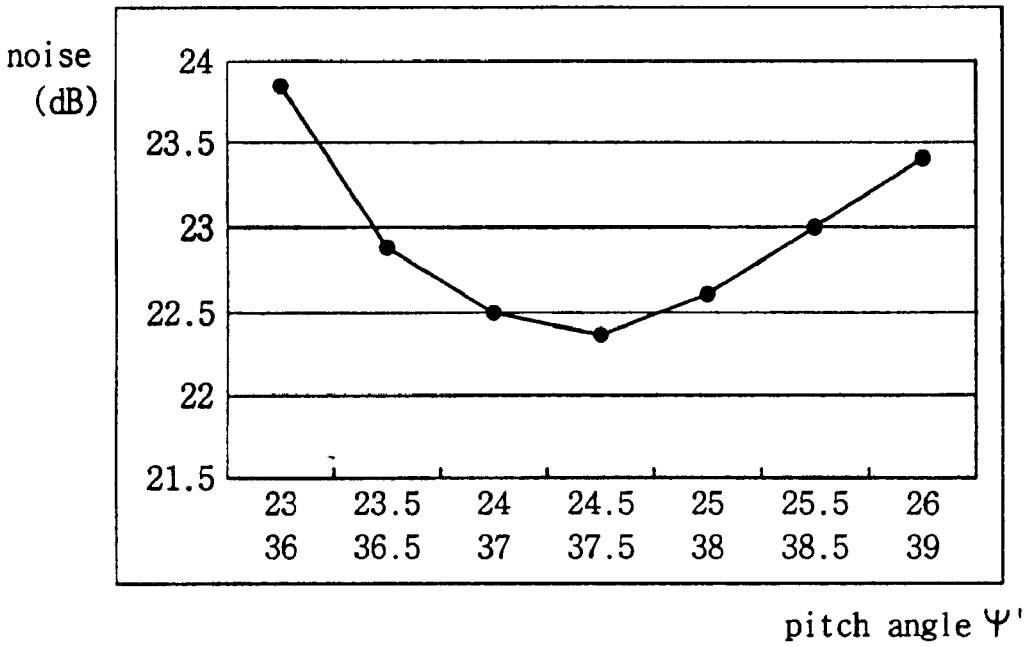
FIG. 18 is a graph showing operational noise of the axial flow fan according to the second embodiment of this invention as a function of the pitch angle of the axial flow fan.

FIG. 18 is a graph showing the operational noise of the axial flow fan as a function of the pitch angle Ψ' of the blades 155. This graph shows that it is possible to accomplish a desired minimum operational noise of 22.4 dB when the pitch angle Ψ' of each blade 155 is set to 37.0°~39.0° at the blade hub BH' and to 24.0°~26.0° at the blade tip BT' while accomplishing a linear distribution on the blade 155 from the blade hub BH' to the blade tip BT'.

Figure 19:
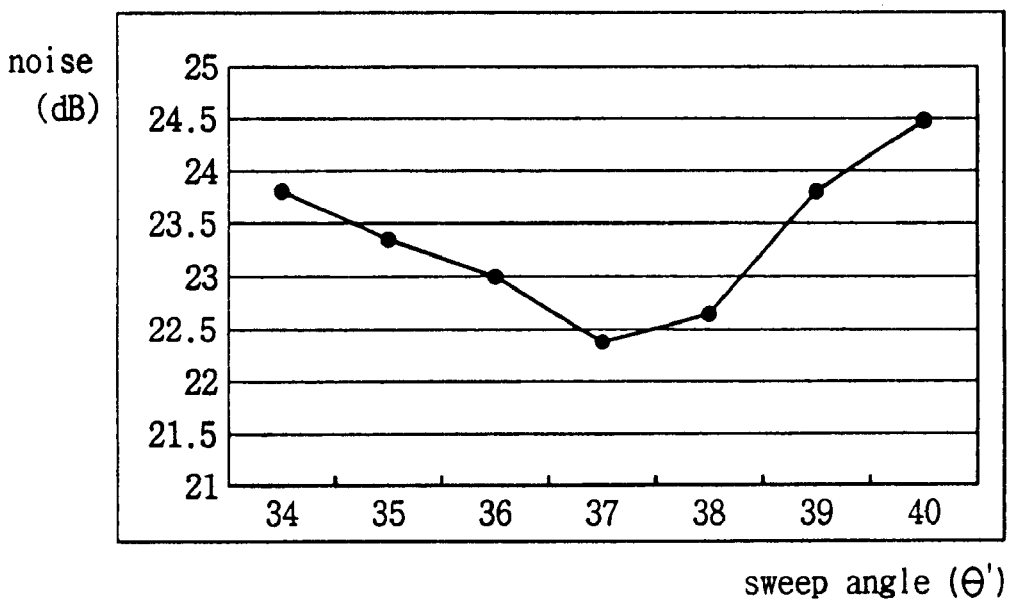
FIG. 19 is a graph showing operational noise of the axial flow fan according to the second embodiment of this invention as a function of the sweep angle of the axial flow fan.

FIG. 19 is a graph showing operational noise of the axial flow fan as a function of the sweep angle θ' of the blades 155. This graph shows that it is possible to accomplish a desired minimum operational noise of 22.5 dB±0.1 when the sweep angle θ' of each blade 155 is set to 0.0° at the blade hub BH' and to 37.0°~38.0° at the blade tip BT' while accomplishing a quadratic-parabolic distribution on each blade 155 from the blade hub BH' to the blade tip BT'.

The boundary data of the blades 155 included in the axial flow fan according to the second embodiment of the present invention is given in Table 2. As expressed in Table 2, the axial flow fan effectively reduces its operational noise by at least 3 dB(A) in comparison with a conventional axial flow fan while providing the same air volume.

TABLE 2

| Blade Width = 18.04 m | | |
|---|---|---|
| X | Y | Z |
| 6.448 | 16.269 | −4.991 |
| 4.900 | 16.800 | −4.144 |
| 3.339 | 17.179 | −3.223 |
| 1.780 | 17.409 | −2.241 |
| 0.238 | 17.498 | −1.209 |
| −1.276 | 17.483 | −0.134 |
| −2.749 | 17.283 | 0.972 |
| −4.129 | 17.006 | 2.164 |
| −5.362 | 16.658 | 3.503 |
| −6.448 | 16.269 | 4.991 |
| −7.159 | 19.061 | 5.809 |
| −7.570 | 21.954 | 6.326 |
| −7.664 | 24.932 | 6.531 |
| −7.410 | 27.980 | 6.425 |
| −6.774 | 31.076 | 6.026 |
| −5.715 | 34.192 | 5.370 |
| −4.116 | 37.301 | 4.469 |
| −1.868 | 40.346 | 3.377 |

TABLE 2-continued

| Blade Width = 18.04 m | | |
|---|---|---|
| X | Y | Z |
| 5.734 | 42.868 | −2.467 |
| 7.366 | 42.618 | −5.253 |
| 9.738 | 42.140 | −6.359 |
| 12.075 | 41.530 | −7.459 |
| 14.448 | 40.765 | −8.370 |
| 16.798 | 39.855 | −9.200 |
| 19.128 | 38.790 | −9.912 |
| 21.429 | 37.568 | −10.495 |
| 23.687 | 36.187 | −10.950 |
| 25.888 | 34.646 | −11.273 |
| 26.628 | 30.368 | −11.436 |
| 22.781 | 29.822 | −10.981 |
| 19.222 | 28.849 | −10.189 |
| 16.020 | 27.477 | −9.191 |
| 13.248 | 25.735 | −8.132 |
| 10.908 | 23.693 | −7.109 |
| 8.998 | 21.408 | −6.203 |
| 7.513 | 18.924 | −5.480 |
| 6.448 | 16.269 | −4.991 |

As described above, the present invention provides an axial flow fan with a BLDC motor for electronic appliances, such as office or domestic electronic appliances. The axial flow fan of this invention is optimally designed in axial height of both the blades and the fan housing, the number of blades, diameter ratio of the inner diameter to the outer diameter of the blades, camber ratio, pitch angle and sweep angle of the blades, thus being reduced in operational noise in addition to being increased in air volume.

Therefore, when the axial flow fan of this invention is used in electronic appliances, such as office or domestic electronic appliances, it is possible to reduce operational noise of the appliances in addition to accomplishing an increase in air volume.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An axial flow fan, comprising a brushless direct current motor, a hub mounted to a rotating shaft of said motor, a plurality of blades mounted to said hub, and a fan housing covering said blades while holding the motor therein, wherein said blades have an axial height relative to a lower surface of said fan housing which is higher than an axial height of an upper surface of said fan housing relative to the lower surface of said fan housing, with a leading surface of said blades being placed outside the upper surface of said fan housing at a position higher than the upper surface of the fan housing by a predetermined projection height, wherein the number of said blades is eight, and wherein an outer diameter of the blades is 86±0.5 mm, while an inner diameter of the blades is 35±0.5 mm, with a front leading distance of the blades being 14.0±0.4 mm and a rear trailing distance of the blades being 4.94±0.4 mm.

2. The axial flow fan according to claim 1, wherein an axial height of the fan housing is 21.0±0.4 mm, while the projection height of said blades from the upper surface of the fan housing is 4.5±0.1 mm.

3. The axial flow fan according to claim 1, wherein a maximum camber position of each of the blades is 0.65~0.7 while accomplishing a uniform distribution on the blade from a blade hub to a blade tip, and a maximum camber ratio of each of the blades is 3.7~4.1% at said blade hub and 9.7~10.1% at said blade tip while accomplishing a linear distribution on the blade.

4. The axial flow fan according to claim 1, wherein a pitch angle of each of the blades is 39.0°~40.0° at a blade hub and 26.0°~27.0° at a blade tip while accomplishing a linear distribution on the blade from the blade hub to the blade tip.

5. The axial flow fan according to claim 1, wherein a sweep angle of each of the blades is 0.0° at a blade hub and 34.0° at a blade tip while accomplishing a quadratic-parabolic distribution on the blade from the blade hub to the blade tip.

* * * * *